US006176273B1

(12) United States Patent
Pezzoli

(10) Patent No.: US 6,176,273 B1
(45) Date of Patent: Jan. 23, 2001

(54) LOOM WEFT YARN FEEDER DEVICE

(75) Inventor: Giulio Pezzoli, Leffe (IT)

(73) Assignee: Lu.Lo.Wal Tex S.N.C. di Pezzoli Giulio & C., Leffe (IT)

( * ) Notice: Under 35 U.S.C. 154(b), the term of this patent shall be extended for 0 days.

(21) Appl. No.: 09/341,388

(22) PCT Filed: Jan. 8, 1998

(86) PCT No.: PCT/EP98/00076

§ 371 Date: Oct. 5, 1999

§ 102(e) Date: Oct. 5, 1999

(87) PCT Pub. No.: WO98/30484

PCT Pub. Date: Jul. 16, 1998

(30) Foreign Application Priority Data

Jan. 8, 1997 (IT) ..... MI97A0011

(51) Int. Cl.[7] ..... B65H 1/22
(52) U.S. Cl. ..... 139/452; 242/365.4
(58) Field of Search ..... 139/452; 242/365.4

(56) References Cited

U.S. PATENT DOCUMENTS 3,834,635 * 9/1974 Pfarrwaller ..... 139/452
5,678,779 * 10/1997 Maina ..... 139/452
5,979,815 * 11/1999 Svanstroem et al. ..... 139/452

* cited by examiner

*Primary Examiner*—Andy Falik
(74) *Attorney, Agent, or Firm*—Flynn, Thiel, Boutell & Tanis, P.C.

(57) ABSTRACT

A brake for loom weft yarn feeding device is arranged between a front portion of the drum, on which the yarn coming from a conventional bobbin is wound, and a space defined by a hollow enclosing and covering element. The covering element has a front orifice and is positioned in front of the drum. The element has a substantially cone-shaped or spherical cap configuration, wherein a brake is provided comprising a body of round, oval or possibly even quadrangular plan, consisting of one or more intermediate segmental rings, within approximately semicircular profile, which are fitted with at least one head in a portion of lesser diameter than those of the segmental rings at either end. The weft yarn is comprised and compressed between the rim of one of the heads and the inner wall of the hall element, immediately before exiting therefrom through the orifice.

20 Claims, 1 Drawing Sheet

LOOM WEFT YARN FEEDER DEVICE

FIELD OF THE INVENTION

The invention relates to a loom weft yarn feeding device having a storing drum from which yarn is removed and a brake for braking the yarn.

BACKGROUND OF THE RELATED ART

Brakes on loom weft yarn feeding devices are suitable for maintaining a desirable tension profile in the weft yarn unwinding from the weft feeder drum, thereby preventing it from breaking. A weft yarn feeder is intended to feed weft yarn coming from a bobbin to a loom. Traditionally, a weft yarn feeder is provided with a braking member placed in the vicinity of the storing drum and acting in the direction of the drum to which the weft yarn is conveyed before exiting therefrom. The braking member has the function of keeping the weft yarn tension as constant as possible, and of preventing the yarn from breaking, which would inevitably cause at least a temporary interruption of the production cycle.

Known brakes for loom weft yarn feeding devices of the lever or ring type are built in such a way as to act systematically in the direction of the drum, and unfortunately possess a number of important disadvantages. The braking member, generally consisting of a disk acting counter to the weft yarn unwinding direction, tends to become deformed in time and then is no longer able to couple with the drum with the required precision. Moreover, during rotation of the withdrawn weft yarn, centrifugal forces tend to lift the weft yarn off the drum whereas the braking member tends to contrast it in the opposite direction. As a result, weft yarn tension, especially at higher withdrawal speeds and higher rotation speeds, increases considerably. The weft yarn itself thus becomes easily subject to breaking, or does not enable a reliable changeover between the loom pincers, e.g. in a rapier loom.

Another drawback with a known braking device using a brake cap generally produced from a plastic material is that the force exerted on the brake cap results in deformations of and wear spots at certain parts of the brake cap. Consequently, the yarn is no longer braked uniformly and exists from the weft yarn feeding device under braking that is not constant. This increases the danger of stretching and breaking the weft yarn.

The brake body of a brake as known from GB 14 25 900, FIG. 8, is an annular tube of circular cross-section made of rubber or plastic material. Said tube is inflated by pressurized air and is seated on a ring provided in the interior of the annular tube. Said ring is mounted to the drum front end portion of the storage drum such that a circumferential region of said annular tube is defining a circumferentially continuous braking rim which is radially held in contact with the covering element inner wall. In operation, supposedly due to the radially oriented force pressing the braking rim against the covering element inner wall such that the braking rim is acting cross-wise or even slightly opposite to the weft yarn withdrawal direction and/or due to the stiffness of the inflated tube, the weft yarn tension occurring in the weft yarn downstream the braking zone significantly varies with varying weft yarn speeds. In another embodiment (GB 1 425 900, FIG. 3), an annular brake body with axially oriented bristles is mounted in the space confined by the cone-shaped covering element. Tips of the bristles radially contact the covering element inner wall. Said bristles define an indefinite plurality of discrete braking tips, but no circumferentially continuous braking rim. This does not allow to achieve a relatively constant downstream tension in the weft yarn when the withdrawal speed of the weft yarn varies, since the friction between the braking tips of the bristles and the yarn progressively increases with increasing weft yarn withdrawal speed.

An object of this invention is to produce a loom weft yarn feeding device having a brake apt to guarantee optimal and constant tension of the weft yarn fed to the loom and to avoid the possibility of yarn breakages.

A further object of the invention is to produce a loom weft yarn feeding device having a brake in which the braking member provided for yarn braking is not subject to local deformation and/or wear which could prevent that the yarn passes the brake under constant braking conditions.

A further object of the invention is to put a brake in a loom weft yarn feeding device at the disposal of users, designed such that it is able to ensure high level resistance and dependability in time, while also being simple and economical to manufacture.

A further object of the invention is to create a loom weft yarn feeding device with a brake having an elastically deformable braking rim wherein the brake has an improved behavior in operation, leading to a relatively constant tension profile in the weft yarn, i.e. avoiding critical tension variations with varying weft yarn speed in weft yarn feeders for different types of looms, like projectile looms, rapier looms, and even jet looms. The brake ought to have an extremely simple design, should operate without changing its braking behavior due to wear and should be suitable for a broad variety of different yarn qualities. The operational behavior of the brake should lead to a self-compensating effect, which means that the brake automatically reduces the braking effect with increasing yarn speed or during temporary acceleration phases and vice versa.

SUMMARY OF THE INVENTION

These and yet further objects are achieved with a loom weft yarn feeding device having an elastically deformable brake body having a radially deformable lip defining a braking rim.

The yarn is compressed between the rim provided on one of the heads and the inner wall of the hollow covering element immediately before exiting therefrom through the front orifice of the covering element. The covering element simultaneously fulfills the function of a balloon limiting structure and a counter-braking surface co-operating with the braking rim in a circumferentially continuous braking zone arranged essentially perpendicular to the axis of the covering element and the storing drum of the weft yarn feeding device.

A self-adjusting traction brake can be achieved by the important fact that the braking rim is axially pressed against the covering element inner wall in essentially the same direction in which the weft yarn is withdrawn from the weft yarn storing device. This means that the braking rim in the brake does not act significantly cross-wise or even counter to the withdrawal direction of the yarn and thus is able to smoothly yield when the yarn circulating inside the covering element is passing the braking zone simultaneous with predominant circulating motion and linear withdrawal speed. Since the weft yarn locally is deforming the braking rim which brakes the yarn against the covering element inner wall in a circumferentially continuous fashion, significant wear of the braking rim can be avoided. If, nevertheless, wear of the braking rim will take place, said wear is extremely uniformly distributed along the circumferentially continuous braking rim so that no local and remaining deformations or wear spots occur in the braking rim. The brake has an extremely simple design and does not significantly suffer from wear but is suitable for a big variety of yarn qualities. From the smooth cooperation between the covering element inner wall and the circumferentially continuous, at least radially deformable braking rim predominantly loaded by contact pressure in essentially the same direction as the weft yarn is withdrawn (traction type brake), results a desirable self-compensating effect.

BRIEF DESCRIPTION OF THE DRAWINGS

An embodiment of the invention will be described with the help of the drawings. In the drawing is.

DETAILED DESCRIPTION

Figure 1:
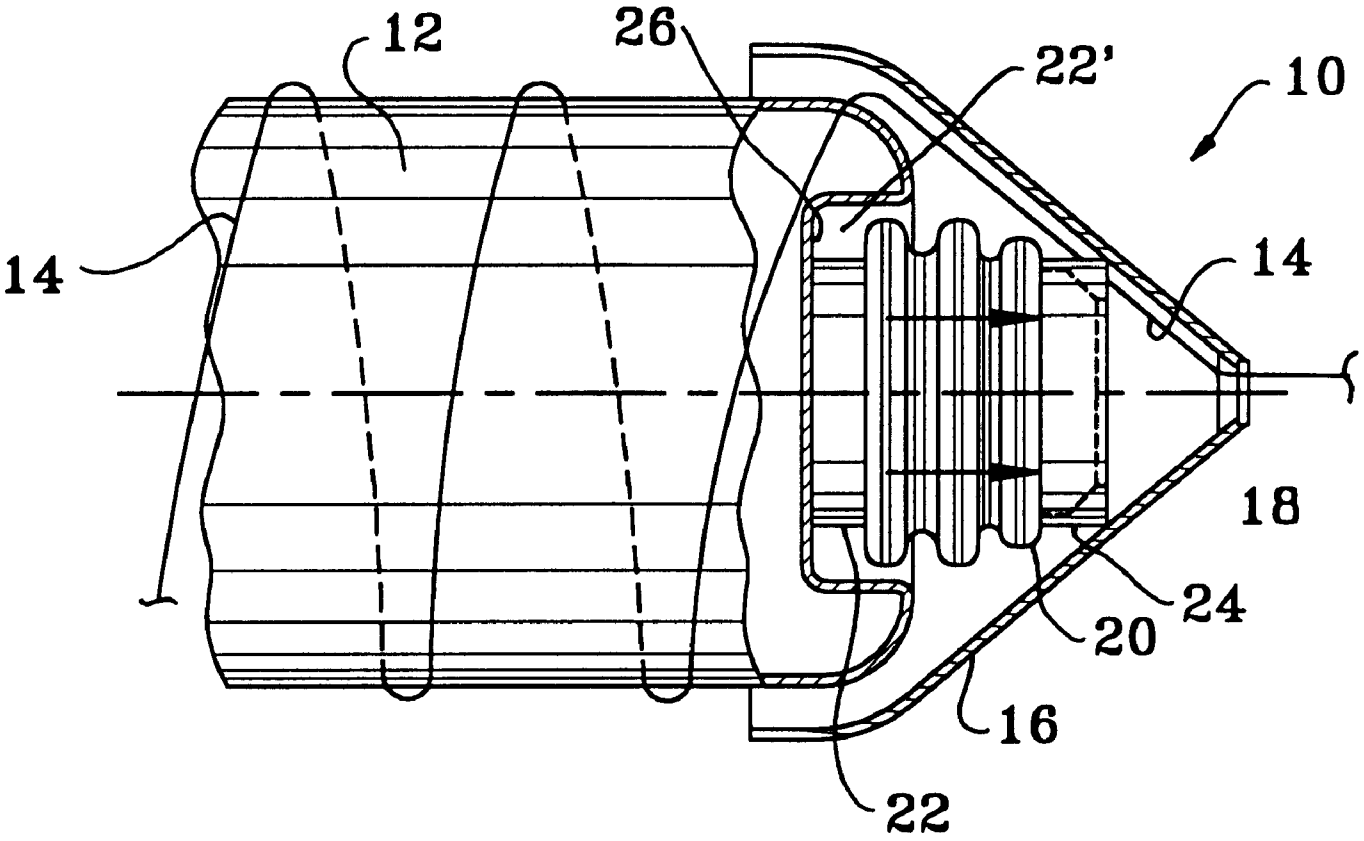
FIG. 1: a schematic partial longitudinal section of a loom weft yarn feeding device equipped with a weft yarn brake.

In FIG. 1 a storing drum 12 of a loom weft yarn feeding device (not shown in detail) is indicated, terminating in a drum front end portion 13. A weft yarn 14, coming from a bobbin (not shown) is wound in adjacent windings by means of a not shown winding-on element onto storing drum 12. In the embodiment shown, storing drum 12 can be a stationary storing drum. Over the drum front end portion 13, a hollow cone-shaped covering element 16 is extending in axial and radial overlapping fashion with a radial clearance between drum front end section 13 and an inner wall 17 of said covering element 16. Covering element 16 is fixed by known means stationarily in relation to drum 12, is provided in its smaller diameter front portion with an orifice 18 and is confining with its inner wall 17 a space in front of said drum front end portion 13. The weft yarn 14 is withdrawn for consumption (e.g. by insertion means of a loom, not shown) from a weft yarn supply on storing drum 12 overhead of drum front end portion 13, further through the space inside covering element 16 and is then exiting through orifice 18 towards the loom.

In front of drum front end portion 13, a brake 10 for the withdrawn weft yarn 14 is provided. According to the invention, in the space defined by covering element or cone 16 and arranged at the same axis as cone 16 an element is provided forming a brake body 20, formed to advantage by a tubular body with different diameters. In the embodiment shown, said brake body 20 has an accordion-like or bellows-like design and is round, oval, or even quadrangular in its longitudinal sectional configuration. Said brake body 20 is comprised by a plurality of ring portions 21 with each having an approximately semi-circular profile. Furthermore, said brake body 20 has rear and front heads 22, 24, each of which is defined by a circular plane portion, e.g. with a diameter smaller than the diameters of the intermediate ring portions 21. The brake body 20 as a whole, i.e. including the rear and front heads 22, 24, is made preferably of rubber, a plastic material, or a metallic sheet material permitting elastic deformation of the brake body 20 lengthwise and/or crosswise, i.e., deformations in axial and/or radial directions.

Brake body 20 is mounted to drum front end portion 13. For this purpose, a recess 32 is made centrally in the front face of said drum front end portion 13 to which the cone or covering element 16 is associated, e.g. held by an external support or a fixture at a mounting bracket (not shown) of the housing of the feeding device. At said drum front end portion 13 in recess 32, a seat 26' is made. For this purpose, a back wall 26 of said recess 32 may define ring-shaped seat 26' or a plate embossment (not shown) of a shape complementary to that of rear head 22 of brake body 20, so that brake body 20 may be stably positioned and centered by means of its rear head 22 at the storing drum 12, e.g. prior to securing the cone or covering element 16 in relation to said drum 12 at the feeding device.

The front head 24 provided at the opposite end of brake body 20 comes into direct contact with weft yarn 14 withdrawn from the outer periphery of storing drum 12 overhead via the rounded drum front end portion 13 and before the weft yarn 14 exits from covering element 16 through orifice 18. The front head 24 of brake body 20 defines in the shown preferred embodiment a lip 25 running essentially parallel to the longitudinal axis of covering element 16 and drum 12 and also to the direction in which the weft yarn 14 exits through orifice 18, as indicated by arrow X. A given flexibility or deformability of front head 24, which is one of the properties of the material the entire brake body 20 is made of permits exact adjustment of the edge or braking rim 23 of said front head 24 to the profile of the inner wall 27 of covering element 16, of which said inner wall 17 is systematically run up against. The weft yarn 14, leaving the drum 12 and obligatorily unwinding according to a cone-shape spiral pattern when leaving the storing drum 12 and later also covering element 16, thus is kept under constant yarn tension between the edge or braking rim 23 of front head 24 and the inner wall 17 of covering element 16. Apparently, said weft yarn 14 will be braked depending on the continuous contact between the axially yieldably loaded braking rim 23 and the inner wall 17 of covering element 16.

The thrust of the brake body 20 transferred by braking rim 23 onto inner wall 17 is internal to the conical spiral path formed by the weft yarn 14 and is directed toward the center of the spiral according to the direction of the movement of the weft yarn 14 in a diameter smaller than the outer diameter of storing drum 12. This allows that the inertia of the weft yarn 14 forms angles, e.g. when passing through the braking zone, differing in function of the weft yarn speed and of the axial position of the braking zone or contact zone between the brake body braking rim 23 and inner wall 17. Upstream said braking zone, the weft yarn 14 is free to move as necessary along its spiral path and with rotation about the axis of storing drum 12. However, covering element 16 there fulfills a balloon limiting function as well as downstream of said braking zone.

In FIG. 1, the weft yarn 14 unwinding according to the above-mentioned cone-shaped spiral pattern is shown as running with a slight distance from the inner wall 17 of covering element 16. However, the weft yarn 14 then apparently will be pushed by the edge or braking rim 23 of front head 24 of brake body 20 in the direction towards inner wall 17. Brake body 20 therefore is acting as a calibrated brake 10 for the weft yarn 14 and is acting in the weft direction, namely along the direction of feeding of the weft yarn 14 to the loom which is the direction indicated by the arrows X.

Bending or elastic deformation of brake body 20 means both, namely the front lip 25 formed by the front head 24, which lip is capable of bending backwards and inwards to adjust to the profile of the inner wall 17, and also the more rear part of brake body 20 on account of its intermediate ring portions 21 with semi-circular profiles each which ring portions 21 act like an accordion and as an absorber of vibrations and tension. As a result, the weft yarn 14 downstream the braking zone is remaining at essentially constant yarn tension measured in the position immediately behind the orifice 18 where the weft yarn 14 is existing from covering element 16. Pressing said braking rim against inner wall 17 in essentially the same axial direction as said weft yarn 14 is withdrawn (arrows X) as well as the deformability of the braking rim 23 and lip 25 where the rotating yarn is passing the braking zone as well as the adaptability of braking rim 23 to the profile of inner wall 17 and the integrated absorber of vibrations and tension, lead in combination to a traction type braking avoiding significant tension fluctuations in the withdrawn weft-yarn 14 which fluctuations could cause yarn breakages.

In the embodiment shown in FIG. 1, the outer contours of ring portions 21 (which also could be of zigzag configuration) are essentially parallel to the axis of covering element 16. However, the contour of brake body 20 with its ring portions 21—in a longitudinal section—could be round, oval or even conical, e.g. with a similar conicity as inner wall 17.

In order not to allow the weft yarn 14 to get caught by the structure of the peripheries of ring portions 21, a sleeve-like protector 29 could be provided outside of braking body 20, e.g. of elastic material so that the deformability and the vibration absorption of the brake body 20 is not disturbed. Furthermore, the outer diameter of rear and front heads 22 and 24 are shown to be smaller than the outer diameter of the contour of said ring portions 21. In alternative embodiments, the outer diameter of at least the front head 24 could be bigger than shown and even as large or larger as the outer diameter of the profiles of ring portions 21. This also can be said for the outer diameter of rear head 22. There the outer diameter could even be bigger than the outer diameter of the contour of ring portions 21.

In a further alternative embodiment, brake body 20 could have a quadrangular longitudinal sectional configuration, i.e., could be a straight section of a tube, e.g. with open front end 31. The front and rear heads 22, 24 then could be integrated into said tube section, even with the same or smaller diameters, or could be carried by said tube section. The longitudinal sectional configuration of brake body 20 in further non-shown embodiments could be round, oval, conical or of other geometrical design. The brake body 20 with its rear and front heads 22, 24 can be a unitary structure, e.g. an injection-molded rubber or plastic part or a unitary part made from sheet metal. However, since the brake body 20 should have a certain capability for vibration absorption and should be soft, it even might be desirable to form the front lip 25 or even front head 24 from another material having more stiffness and being more wear-proof than the material in the region of ring portions 21. In another alternative embodiment, an annular reinforcement body (indicated at 27) could be mounted, e.g. glued, onto front head 24, then, e.g., defining braking rim 23. Said reinforcement ring could be also be fixed at the front-most ring portions 21 instead of front head 24. Most preferably, brake body 20 with its front and rear heads 24, 22 is open on both ends in order to assure the necessary deformability of the ring portions 21 and particularly of the front head 24 with its braking rim 23. However, in order to hinder lint and contaminations being collected inside brake body 20, it may be desirable to close at least the front end of brake body 20, e.g. by a deformable partition wall 28. In order not to disturb the movability of lip 25 with its braking rim 23, the transition 28' from said separation wall 28 into the braking body 20 could be set back in relation to braking rim 23 (indicated in FIG. 1 in dotted lines).

Regardless of the position the weft yarn 14 is assuming as it moves through covering element 16, it systematically has to encounter the edge or braking rim of front head 24 of brake body 20, i.e. has to pass braking zone between braking rim 23 and inner wall 17. Due to the cooperation between braking edge 23 and inner wall 17, the yarn is maintained at constant tension.

Since the active braking member, namely front head 24 with its braking rim 23, is part of brake body 20 and is acting in the same direction as the weft yarn 14 is fed to the loom; furthermore, since there are ring portions of the brake body 20 with substantially semi-circular profile providing an overall bellows-like structure, any vibrations will be absorbed without deteriorating the effect of constant braking on the weft yarn 14.

The brake body 20 could have any profile and outer diameter. It even might be cone-shaped to match at least in part with the inner wall 17 of covering element 16. Said ring portions 21 have not necessarily to be of semi-circular profile, because other profile forms could be used as well. In certain cases the ring portion outer contour could, at least in part, conform to the shape of the inner wall 17. The brake body 20 then could even form several or numerous points of contact for the weft yarn 14 and with the inner wall 17 so that several braking zones will be formed in a series of at least two of them. In another embodiment, brake body 20 could be made of two ore more parts, at least one of which then is elastically deformable. Both parts could be separated by elastic means, such as, e.g. spiral springs or similar spring components.

Covering element 16 is shown with an essentially frustoconical jacket format. However, covering element 16 could be of different configuration, e.g. could have a spherical cap shape and internally accommodate a correspondingly shaped brake body 20 of complementary or smaller diameter.

One important feature of the invention is that the brake body 20 is designed with its longitudinal cross-sectional configuration so as to press the braking rim 23 essentially in the axial weft yarn withdrawal direction X against the covering element inner wall 17. In connection with the circumferentially continuous braking rim 23 formed by an at least radially deformable portion of brake body 20, this leads to a desirable traction type brake in which said braking rim 23 does not act counter or significantly cross-wise in relation to the axial weft yarn withdrawal direction.

What is claimed is:

1. A loom weft yarn feeding device, comprising a drum for storing a wound-on weft yarn for overhead withdrawal, a hollow, essentially frustoconical or spherical covering element arranged essentially coaxially with said drum in an axially and radially overlapping fashion circumscribing a drum front end portion with radial and axial clearance so as to define in front of the drum end portion a space for the passage of the withdrawn weft yarn exiting said covering element via a front orifice, and comprising a brake including an elastically deformable brake body including at least one circumferentially continuous and elastically deformable braking rim yieldably contacting a covering element inner wall in an essentially circular braking zone oriented essentially perpendicular to the drum axis and axially distant from said drum front end portion, said brake body being mounted to said drum front end portion, comprising the improvement wherein the brake body is provided with a circular front head terminating at its front end in a radially deformable lip defining said braking rim, and that said braking rim is pressed by said brake body essentially in the axial weft yarn withdrawal direction against the covering element inner wall.

2. A device according to claim 1, wherein said front head defines an essentially straight cylindrical portion of said brake body.

3. A device according to claim 2, wherein said cylindrical portion—in a longitudinal cross-section of said brake body—defines a plane lip extending essentially parallel to the longitudinal axis of said covering element.

4. A device according to claim 2, wherein the outer diameter of said front head of said brake body is equal to or less than the outer diameter of the brake body.

5. A device according to claim 1, wherein the brake body has a varying diameter and at least one circumferentially extending intermediate ring portion with a plurality of subsequent ring portions in an accordion-like or bellows-like arrangement, each of said ring portions oriented essentially perpendicular to the axis of the covering element.

6. A device according to claim 5, wherein in a longitudinal section through said brake body, the sectional profile of each ring portion is essentially semi-circular.

7. A device according to claim 5, wherein the brake body by its ring portions of varying diameter defines a vibration absorber integrated between the front head contacting the covering element inner wall and the rear end of the brake body centered at the drum front end portion.

8. A device according to claim 1, wherein the brake body with its front head defines a tubular structure with an open mouth inside said braking rim.

9. A device according to claim 1, wherein the brake body is provided with front and rear cylindrical heads of equal or different diameters and entirely defines a tubular structure.

10. A device according to claim 1, wherein the front head or at least a front end portion of said front head is made of a material more wear-resistant and/or more rigid than the material defining said brake body and/or said ring portions.

11. A device according to claim 10, wherein an annular reinforcement element defining the braking rim is provided on the front head or on the brake body instead of said front head.

12. A device according to claim 1, wherein the front head is closed by an inner elastic partition wall, the transition between said partition wall and said front head or said brake body being axially set back in relation to said braking rim.

13. A device according to claim 1, wherein the brake body comprises an active braking member and is made from elastically deformable material.

14. A device according to claim 1, wherein at the drum front end portion of said drum a seat is made with which said brake body is coupled for centering, accommodating, and/or stabilizing mainly said rear head or said brake body.

15. Device according to claim 1, wherein said seat for the brake body is provided within a recess defined in a back wall of said drum front end portion, said seat being a ring-shaped seat or a plate embossment of a complementary shape to that of said rear head.

16. A device according to claim 1, wherein the brake body has a substantially truncated cone-shaped profile, corresponding to that of the inner wall of the hollow covering element.

17. A device according to claim 1, wherein the brake body has a spherical cap-shaped profile, corresponding to that of the inner wall of the hollow covering element.

18. A device according to claim 1, wherein the brake body comprises two or more elements, at least one of which is elastically deformable, said elements being separated by elastic means.

19. A device according to claim 1, wherein profile and diameter variations of the brake body are defined by its ring portions, said brake body defining at least one braking zone wherein a front braking zone is defined by the braking rim contacting the covering element inner wall.

20. A device according to claim 1, wherein the brake body exteriorly is covered by a sleeve shaped protector circumscribing said ring portions, said protector being made of elastic material.

* * * * *